US007448524B1

(12) United States Patent
Liang et al.

(10) Patent No.: US 7,448,524 B1
(45) Date of Patent: Nov. 11, 2008

(54) MOVEABLE CYLINDER DRIVING AIR PASSAGE OF NAIL GUN

(75) Inventors: Chia-Sheng Liang, Taipei Hsien (TW); Chin Lung Chang, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/752,026

(22) Filed: May 22, 2007

(51) Int. Cl.
*B25C 1/04* (2006.01)

(52) U.S. Cl. ..... 227/130; 227/120

(58) Field of Classification Search ..... 227/130, 227/120; 173/218, 219
See application file for complete search history.

(56) References Cited

U.S. PATENT DOCUMENTS

| | | | | | |
|---|---|---|---|---|---|
| 3,563,438 | A | * | 2/1971 | Doyle et al. | 227/8 |
| 3,638,532 | A | * | 2/1972 | Novak | 91/220 |
| 3,653,299 | A | * | 4/1972 | Howard | 91/416 |
| 3,685,396 | A | * | 8/1972 | Obergfell | 91/356 |
| 3,771,710 | A | * | 11/1973 | Perkins et al. | 227/130 |
| 3,788,195 | A | * | 1/1974 | Lange | 91/457 |
| 3,850,079 | A | * | 11/1974 | Fehrs | 91/308 |
| 4,294,391 | A | | 10/1981 | Obergfell | |
| 4,319,705 | A | | 3/1982 | Geist et al. | |
| 4,384,668 | A | * | 5/1983 | Tutomu et al. | 227/8 |
| 4,784,308 | A | | 11/1988 | Novak et al. | |
| 5,829,660 | A | * | 11/1998 | White | 227/8 |
| 5,850,961 | A | * | 12/1998 | Braun et al. | 227/130 |
| 5,873,510 | A | * | 2/1999 | Hirai et al. | 227/130 |
| 6,006,975 | A | * | 12/1999 | Ishizawa | 227/119 |
| 6,783,050 | B2 | * | 8/2004 | Ishizawa et al. | 227/130 |
| 7,290,691 | B1 | * | 11/2007 | Wen | 227/8 |
| 7,293,684 | B1 | * | 11/2007 | Wen | 227/130 |
| 7,296,721 | B1 | * | 11/2007 | Wen | 227/130 |

FOREIGN PATENT DOCUMENTS

| | | |
|---|---|---|
| TW | 439630 | 6/2001 |
| TW | 1 263565 | 10/2006 |

* cited by examiner

*Primary Examiner*—Brian D Nash

(57) ABSTRACT

A nail gun includes a moveable cylinder, an air collecting chamber and a main passage. An air passage includes a trigger valve; an air-in passage formed in the trigger valve connecting between an air collecting chamber and a main passage; an air-out passage formed in the trigger valve connecting between the main passage and external atmosphere; a stopper ring formed at an outside surface of the cylinder and slidably attached in the gun body; an air tank formed at a stopper ring; and a main chamber formed at a bottom portion of the stopper ring. The main chamber is capable of collecting the high pressure air via the air-in passage to actuate the cylinder to move up while the valve bar is pressed, and exhausting the high pressure air via the air-out passage to actuate the cylinder to move down for reposition while the valve bar is released.

6 Claims, 7 Drawing Sheets

MOVEABLE CYLINDER DRIVING AIR PASSAGE OF NAIL GUN

BACKGROUND

The present invention relates to moveable cylinder driving air passages, and particularly to a configuration of a high pressure air passage between a trigger valve and a moveable cylinder. When a valve bar of the trigger valve is pressed to open the trigger valve, the high pressure air in the air passage is actuated to drive the cylinder to move up.

The related arts, such as U.S. Pat. No. 4,784,308, U.S. Pat. No. 4,319,705, and U.S. Pat. No. 4,294,391, respectively disclosed a moveable cylinder installed in a gun body of a nail gun. The nail gun includes a head valve separately disposed on the moveable cylinder, a main passage disposed in the gun body connecting between an upper chamber and a trigger valve. The trigger valve is actuated to be opened to exhaust compressed air for hitting nails. Before pressing a valve bar of the trigger valve, the trigger valve guides the high pressure air into the upper chamber via the main passage, to actuate the head valve to move down to push down the cylinder and close the valve port between the head valve and the cylinder. When the valve bar is pressed, the trigger valve exhausts the high pressure air concentrating in the main passage and the upper chamber, to drive the head valve and the cylinder to move up. The head valve moves up at a distance longer than that of the cylinder, so as to open the valve port between the head valve and the cylinder. Then the high pressure air is guided into the cylinder to actuate a piston to move down to hit nails.

However, with these configurations, the head valve and the moveable cylinder are needed to be installed in the nail gun at the same time, which makes a configuration of the air passages unduly complicated, the number of the elements installed in the nail gun unduly larger, and an assembled process unduly burdensome.

Other related arts, such as TW Patent No. 439,630 and TW Patent No. 1263,565 respectively disclosed a fixed cylinder installed in a gun body of a nail gun. A trigger valve of the nail gun is actuated to be opened to concentrate the high pressure air for hitting nails. When a valve bar is pressed to open the trigger valve, the high pressure air is guided into a cylinder via a main passage to actuate a piston to move down for hitting nails. With these configurations, the head valve is omitted.

However, a lower rate of guiding the high pressure air into the fixed cylinder detracts from a utilization of energy of the high pressure air for driving a piston to hit nails. Therefore, these configurations cannot apply to nail guns in a large scale.

Accordingly, what is needed is a moveable cylinder driving air passage of a nail gun that can overcome the above-described deficiencies.

BRIEF SUMMARY

An exemplary moveable cylinder driving air passage of a nail gun is provided. The nail gun includes a moveable cylinder, an air collecting chamber and a main passage. The air passage includes a trigger valve disposed between the air collecting chamber and the main passage; an air-in passage formed in the trigger valve connecting between the air collecting chamber and the main passage; an air-out passage formed in the trigger valve connecting between the main passage and external atmosphere; a valve bar slidably disposed in the trigger valve, the valve bar being capable of closing the air-in passage and opening the air-out passage while being released and opening the air-in passage and closing the air-out passage while being pressed; a stopper ring formed at an outside surface of the moveable cylinder and slidably attached in the gun body; an air tank formed at an upper portion of the stopper ring and a main chamber formed at a bottom portion of the stopper ring; and the main chamber connects with the air-in passage and the air-out passage.

The main chamber is capable of concentrating the high pressure air via the air-in passage to actuate the moveable cylinder to move up while the valve bar is pressed, and is also capable of exhausting the high pressure air via the air-out passage to actuate the moveable cylinder to move down for reposition while the valve bar is released.

The air passage further includes a cylinder sleeve disposed at the outside surface of the moveable cylinder and at an inner surface of the gun body. The air tank is formed in the cylinder sleeve, and the cylinder sleeve includes at least one through hole for continuously guiding the high pressure air from the air collecting chamber into the air tank.

The cylinder sleeve includes a main valve port formed at an upper portion thereof, adjacent to the air collecting chamber. The moveable cylinder includes a main valve formed at an upper portion thereof, which is used for opening the main valve port while the moveable cylinder moving up and closing the main valve port while the moveable cylinder moving down for reposition.

The moveable cylinder includes a top through hole adjacent to an end of the main valve. The high pressure air is capable of being guided from the air collecting chamber into the moveable cylinder via the top through hole while the main valve port is opened. The top through hole is blocked while the main valve port is closed.

It further includes a spring disposed between the cylinder sleeve and the stopper ring for driving the moveable cylinder to move down.

It further includes a spacing ring formed between the outside surface of the moveable cylinder and the inner surface of the gun body, and the main chamber is formed between an upper portion of the spacing ring and a bottom portion of the stopper ring.

The main chamber is connected with the air-in passage and the air-out passage via the man passage of the trigger valve.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
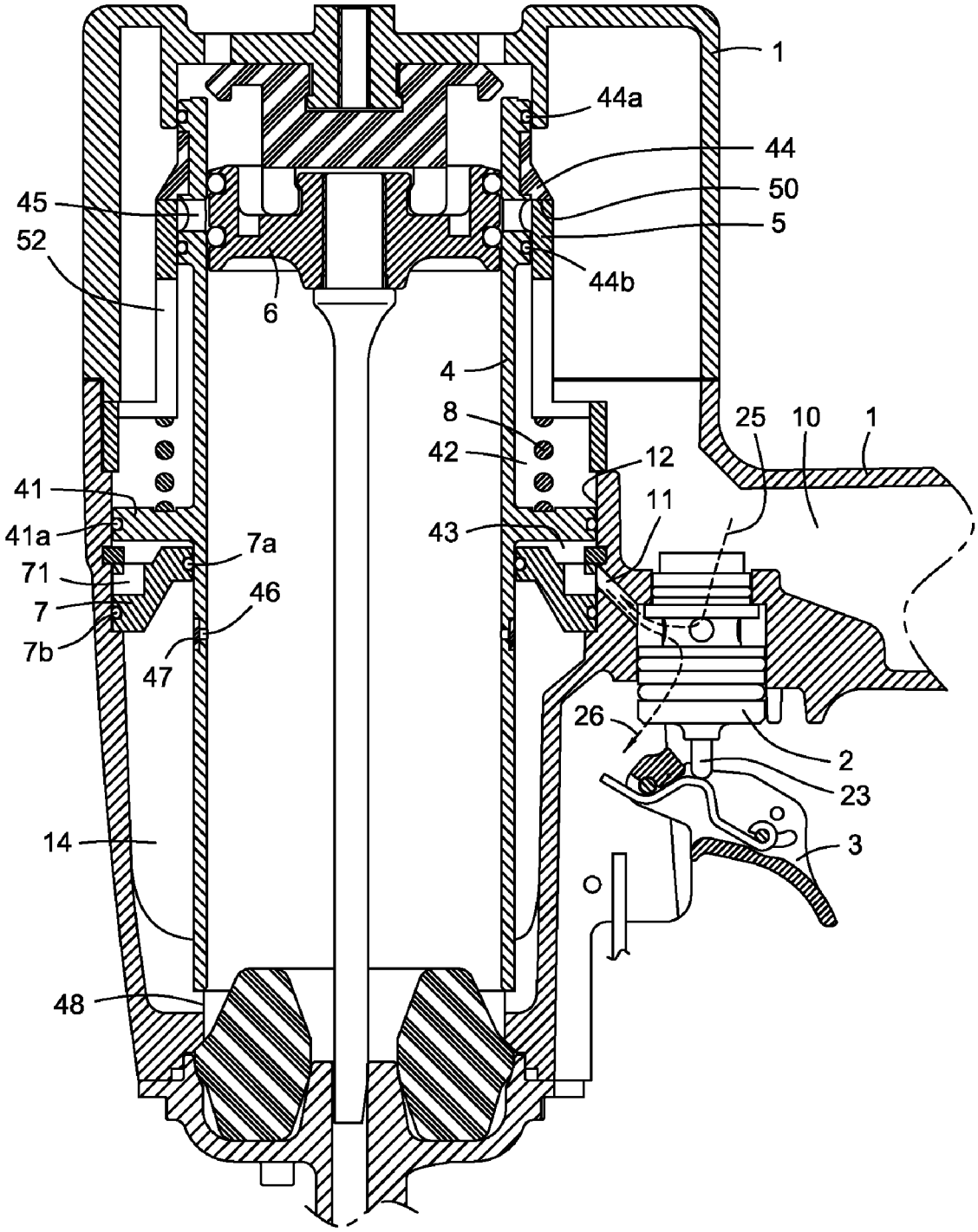
FIG. 1 is a schematic, cross-sectional view of part of a nail gun installing driving air passages of a moveable cylinder according to an exemplary embodiment of the present invention.

Referring to FIG. 1, a schematic, cross-sectional view of part of a nail gun installing driving air passages of a moveable cylinder according to an exemplary embodiment of the present invention is shown. The nail gun includes a gun body 1 and a trigger valve 2 engaged in the gun body 1, and the trigger valve 2 is opened to concentrate the high pressure air for hitting nails.

Figure 1A:
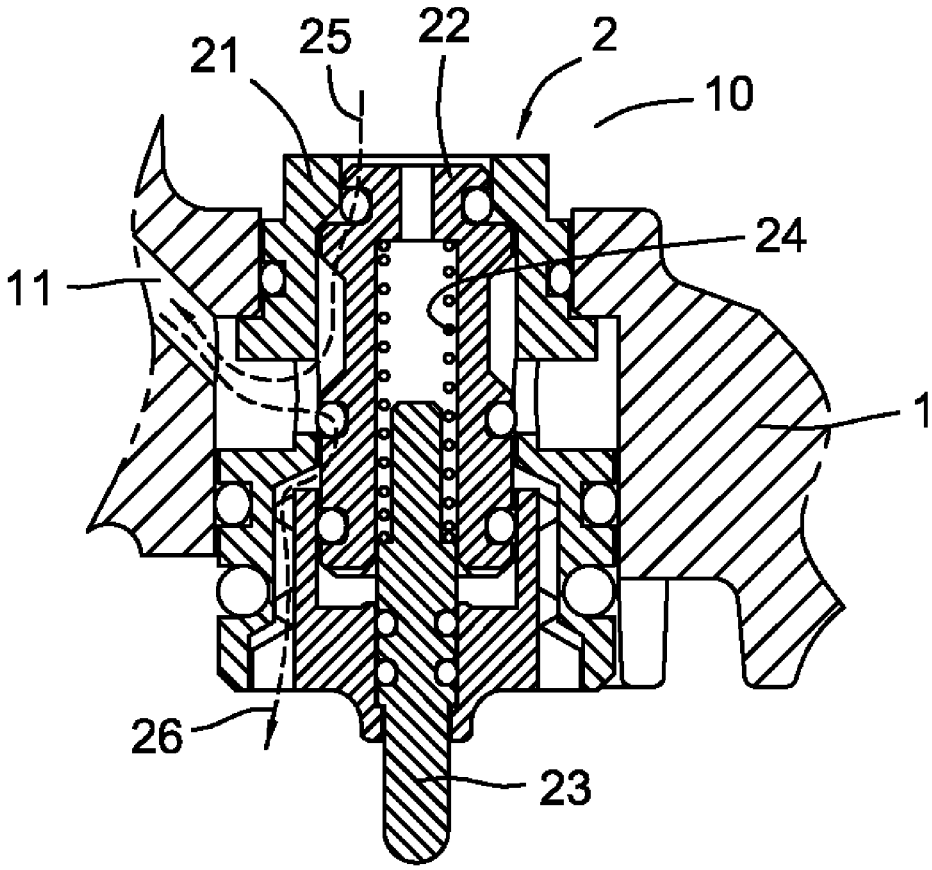
FIG. 1*a* is an enlarged, cross-sectional view of a trigger valve of the nail gun FIG. 1.
Figure 2:
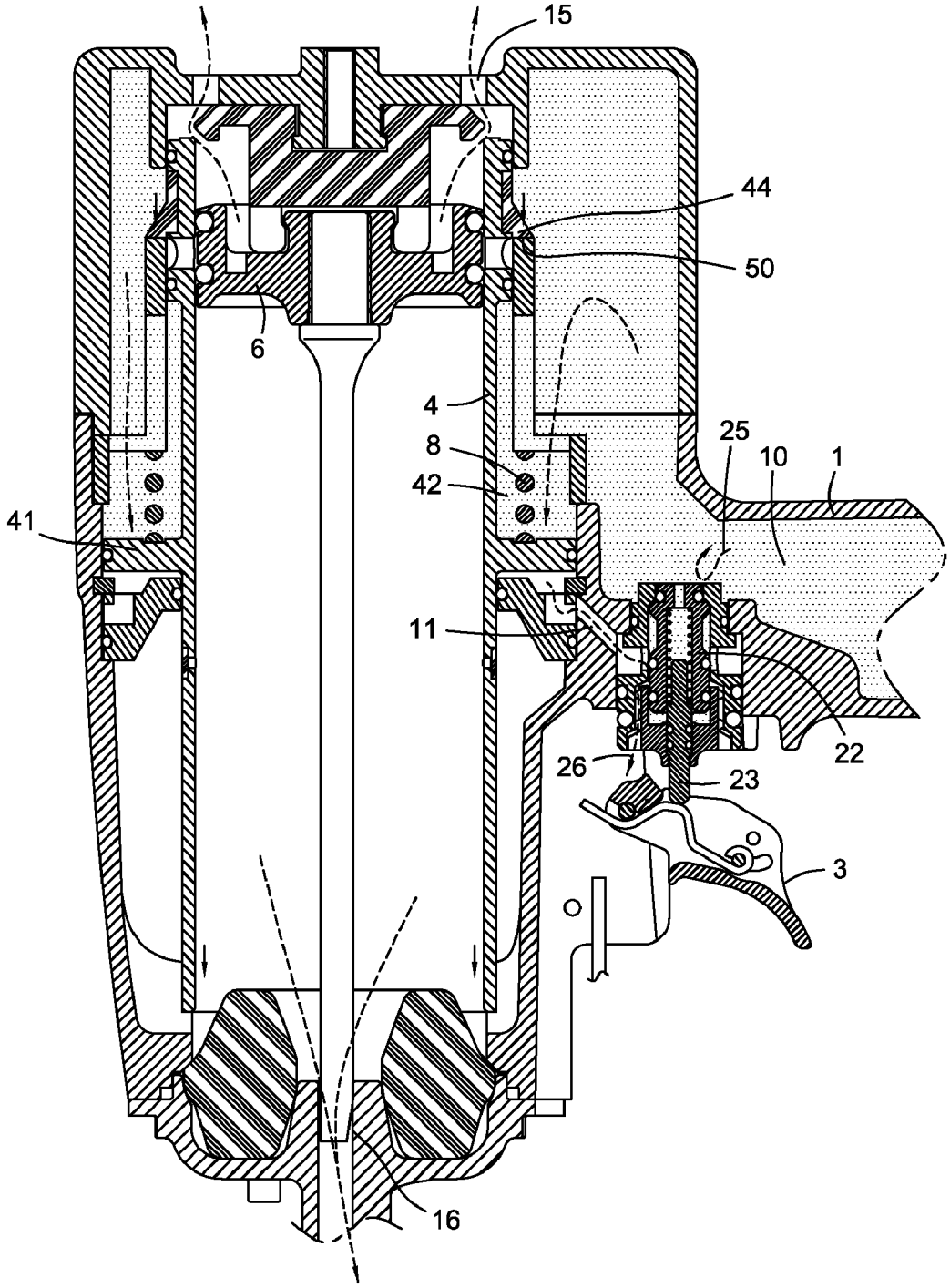
FIG. 2 is a schematic, cross-sectional view of part of the nail gun of FIG. 1, showing a state of before a valve bar of the trigger valve being pressed.

The gun body 1 includes a main passage 11 and an air collecting chamber 10 for concentrating air and maintaining a certain high pressure therein. The trigger valve 2 is disposed between the air collecting chamber 10 and the main passage 11. The trigger valve 2 includes a valve base 21, a shuttle valve 22 (as shown in FIG. 1*a*) disposed in the valve base 21, and a valve bar 23 slidably disposed in the shuttle valve 22. The valve bar 23 is capable of being pressed, and a spring 24 is nested between the shuttle valve 22 and the valve bar 23. A trigger 3 is pivotally attached to the gun body 1 adjacent to the bottom portion of the valve bar 23.

The operator can press the trigger 3 to actuate the valve bar 23 to move up and release the trigger 3 to actuate the valve bar 23 to move down for reposition. Moreover, the trigger valve 2 forms an air-in passage 25 connecting between the air collecting chamber 10 and the main passage 11, and an air-out passage 26 connecting between the main passage 11 and external atmosphere.

The configuration of the trigger valve 2 is not limited to above illustrated embodiment. In other words, other trigger valves with a valve bar that being able to guide the high pressure air into a main passage when being pressed can be installed in the gun body 1 according to the present invention.

The driving air passages of this illustrated embodiment, is capable of being combined with the trigger valve 2 for actuating a moveable cylinder 4. The moveable cylinder driving air passages include a stopper ring 41 (as shown in FIG. 1) formed at an outside surface thereof, and the stopper ring 41 is slidably attached to a ring-shaped inner surface 12 of the gun body 1 via an air tight ring 41*a*. The moveable cylinder driving air passages also include an air tank 42 formed at an upper portion of the air tight ring 41*a* for concentrating the high pressure air from inside of the air collecting chamber 10, and a main chamber 43 formed at a bottom portion of the air tight right 41*a* and connecting with the air-in air passage 25 and the air-out passage 26. In detail, the air tank 42 is formed in a ring-shaped cylinder sleeve 5 (as shown in FIG. 1), and the cylinder sleeve 5 is fixed to an external portion of the cylinder 4 and at the inner surface of the gun body 1. The cylinder sleeve 5 includes at least one through hole 52 for continuously guiding the high pressure air from the air collecting chamber 10 into the air tank 42.

The cylinder sleeve 5 includes a ring-shaped main valve port 50 (as shown in FIG. 1) formed at an upper portion thereof adjacent to the air collecting chamber 10. The cylinder 4 includes a ring-shaped main valve 44 formed at an upper portion thereof for closing or opening the main valve port 50. The main valve 44 includes an air tight ring 44*a* formed at an upper end thereof and an air tight ring 44*b* formed at a bottom end thereof. The cylinder 4 includes a top through hole 45 adjacent to an end of the main valve 44, and the top through hole 45 is formed between the air tight rings 44*a*, 44*b*. The high pressure air in the air collecting chamber 10 can be guided into the cylinder 4 via the top through hole 45 of the main valve 44 when the main valve port 50 is opened. The top inner surface of the cylinder sleeve 5 can be used as ring cylinder surface for guiding the cylinder 4 moved up and down.

Furthermore, the cylinder 4 includes a valve ring 47 and a plurality of middle valve hole 46 formed at a middle portion thereof. The valve ring 47 actuates the middle valve holes 46 to limit the cylinder 4 that can only exhaust air in a single direction via the middle valve holes 46. The cylinder 4 includes a bottom through hole 48 formed at a bottom portion thereof, and a piston 6 slidably attached in the cylinder 4 for hitting nails. A spring 8 is disposed between the cylinder sleeve 5 and the stopper ring 41 to aid in keeping the cylinder 4 at a down position driven by the high pressure air concentrating in the air tank 42.

In addition, a spacing ring 7 (as shown in FIG. 1) is disposed between the outside surface of the moveable cylinder 4 adjacent to a bottom portion of the stopper ring 41 and the inner surface of the gun body 1. The space ring 7 includes an air tight ring 7*a* formed at an inner surface thereof and an air tight ring 7*b* formed at an outside surface thereof, to separate the main chamber 43 to form between the upper portion of the spacing ring 7 and the bottom portion of the stopper ring 41. The spacing ring 7 includes air hole 71 connecting between the main chamber 43 and the main passage 11, so as to make the main chamber 43 to connect with the air-in passage 25 and the air-out passage 26 of the trigger valve 2. Moreover, the air hole 71 can be omitted, it only needs that the spacing ring 7 can separate the main chamber 43 and make the main chamber to connect with the air-in passage 25 and the air-out passage 26 via the main passage 11. Furthermore, the bottom portion of the spacing ring 7 is separated to form a return chamber 14 that is disposed between the outside surface of the cylinder 4 and the inner surface of the gun body 1. The return chamber 14 is connected with the cylinder 4 via the bottom through hole 48. The cylinder 4 can exhaust the high pressure air into the return chamber 14 via the middle valve hole 46 in the single direction.

Figure 3:
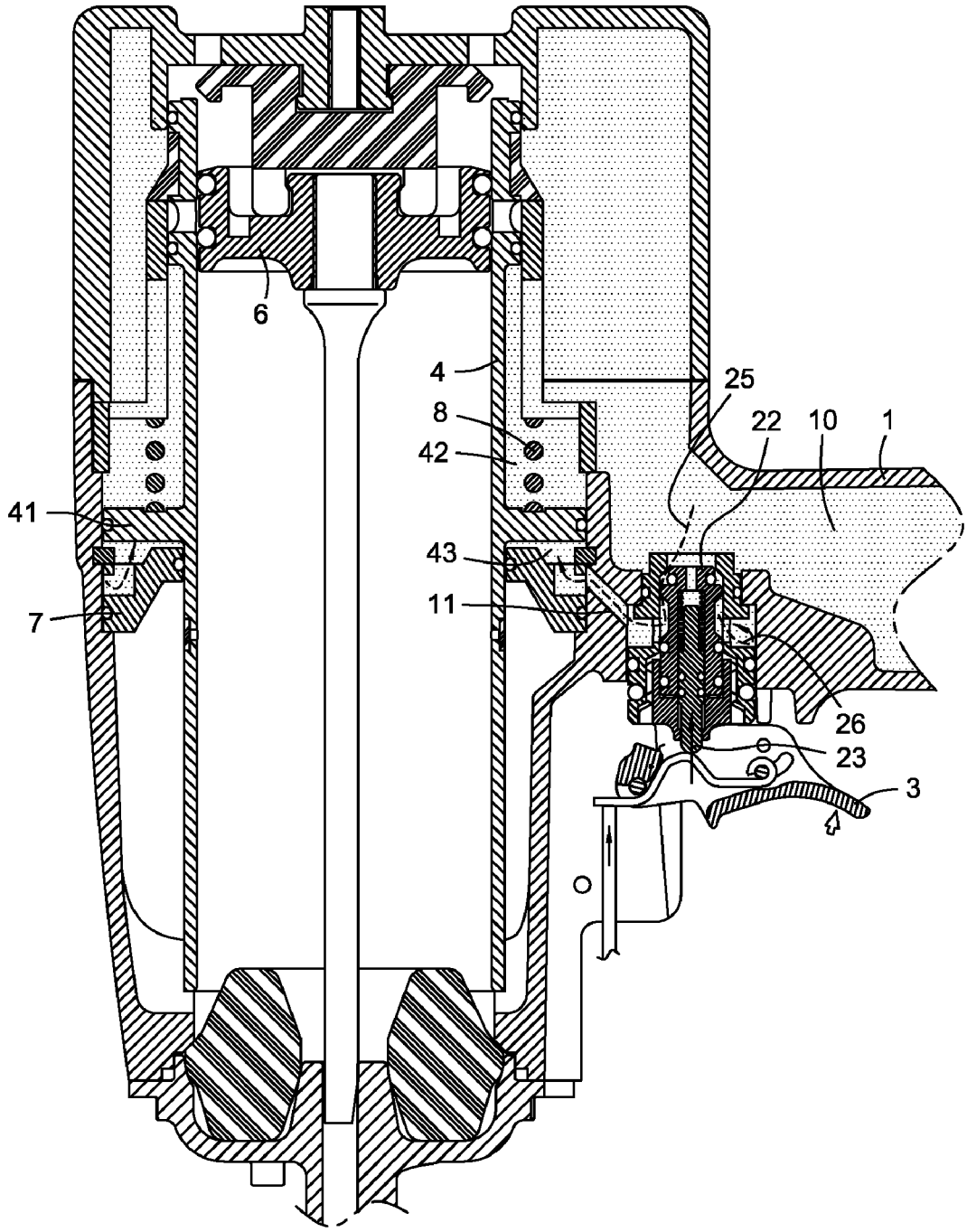
FIG. 3 is a schematic, cross-sectional view of part of the nail gun of FIG. 1, showing the high pressure air being guided into a main chamber of the nail gun.

In operation, before pressing the valve bar 23 via pressing the trigger 3 (as shown in FIG. 3) and the air collecting chamber 10 concentrating air and maintaining a certain high pressure therein, the high pressure air in the air collecting chamber 10 actuates the shuttle valve 22 to move up to close the air-in passage 25 and open the air-out passage 26, so as to prevent the high pressure air in the chamber from transforming into the main passage 11 via the trigger valve 2. At the same time, the cylinder 4 is kept at a down position being actuated by the high pressure air in the air tank 42 and the pushing force generated by the spring 8 that applying to the stopper ring 41. An upper air exhausting hole 15 and a bottom air exhausting hole 16 of the gun body 1 are opened, and then residual air in upper and bottom portions of the piston 6 in the cylinder 4 are exhausted to external atmosphere.

Figure 4:
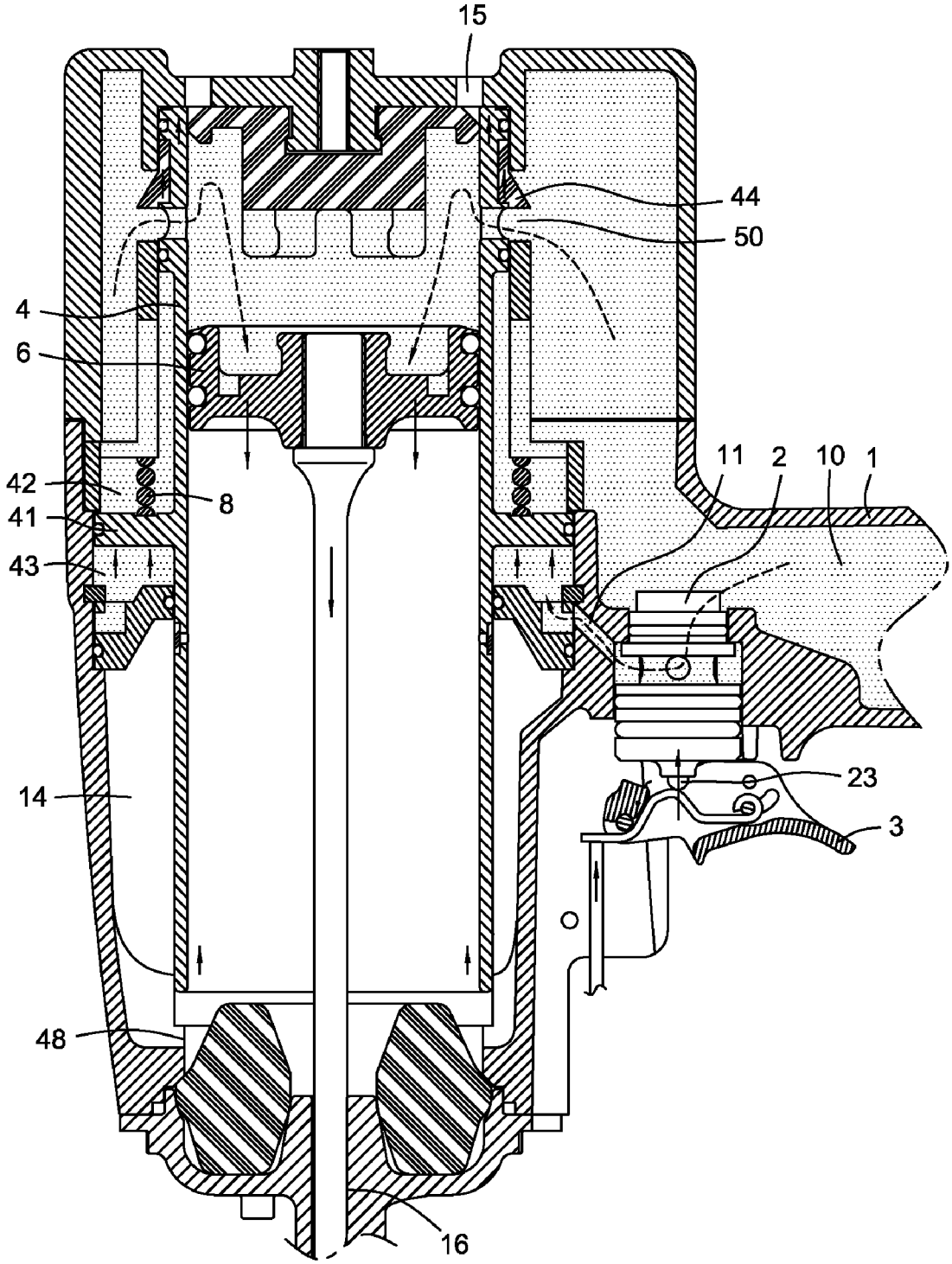
FIG. 4 is a schematic, cross-sectional view of part of the nail gun of FIG. 1, showing the high pressure air in the main chamber being guided to drive the moveable cylinder to move up.
Figure 5:
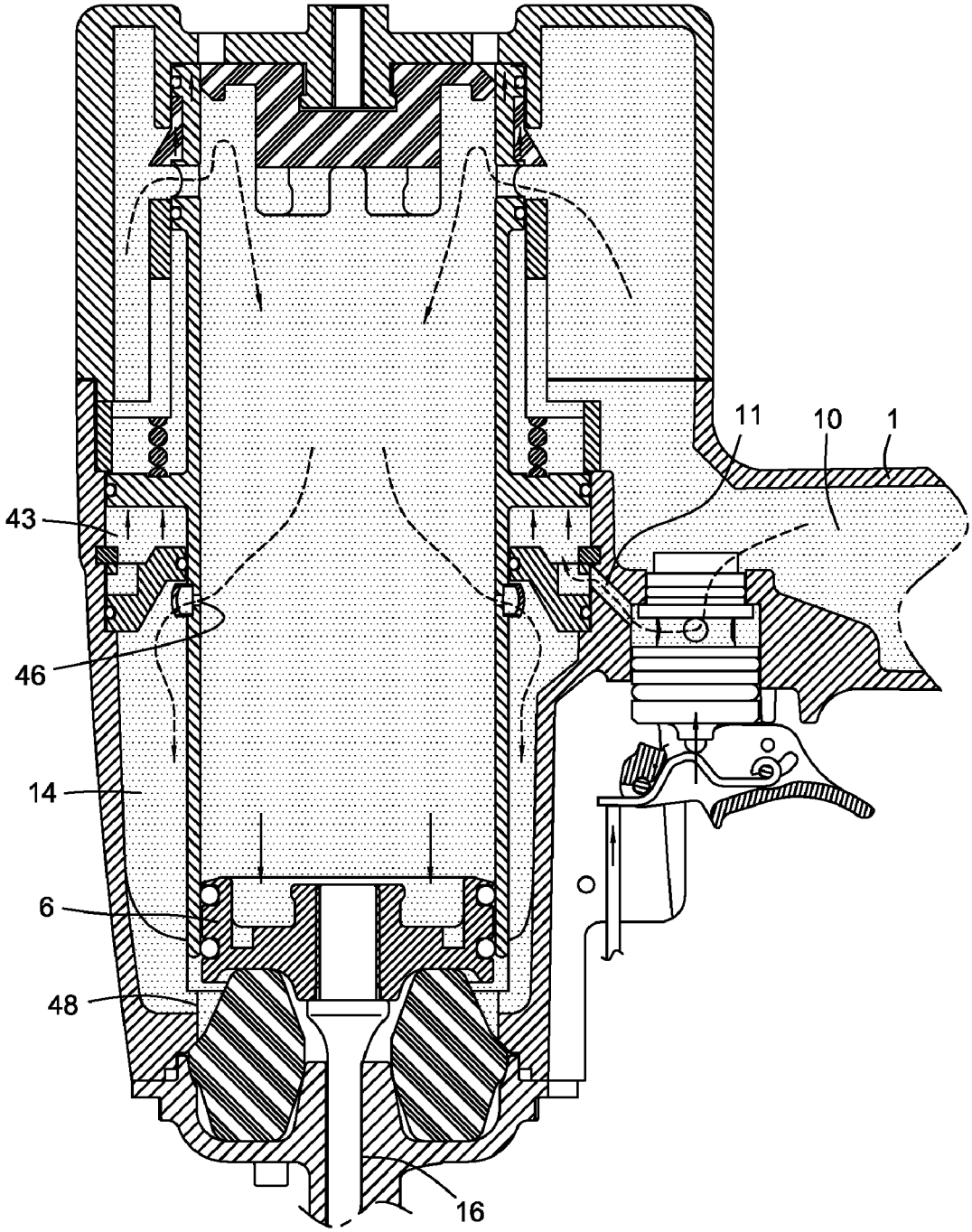
FIG. 5 is a schematic, cross-sectional view of part of the nail gun of FIG. 1, showing the high pressure air being guided into the moveable cylinder to actuate a piston to move down to hit nails.

When the valve bar 3 is pressed (as shown in FIG. 3), the high pressure air in the air collecting chamber 10 drives the shuttle valve 22 to move down to close the air-out passage 26 and open the air-in passage 25. The high pressure air in the air collecting chamber 10 are continuously guided into the main chamber 43 via the main passage 11, and generates a pushing force to actuate the stopper ring 41 to push the cylinder 4 to move up (as shown in FIG. 4). At the same time, the upper air exhausting hole 15 is closed, and the main valve 44 opens the main valve port 50, to guide the high pressure air in the air collecting chamber 10 into the cylinder 4 for driving the piston 6 to move down to hit nails. When the piston 6 moves down and exceeds the position of the middle valve hole 46 (as shown in FIG. 5), the high pressure air above the piston 6 are guided into the return chamber 14 via the middle valve hole 46, and then the piston 6 closes the bottom air exhausting hole 16 when it moves down to the bottom position.

Figure 6:
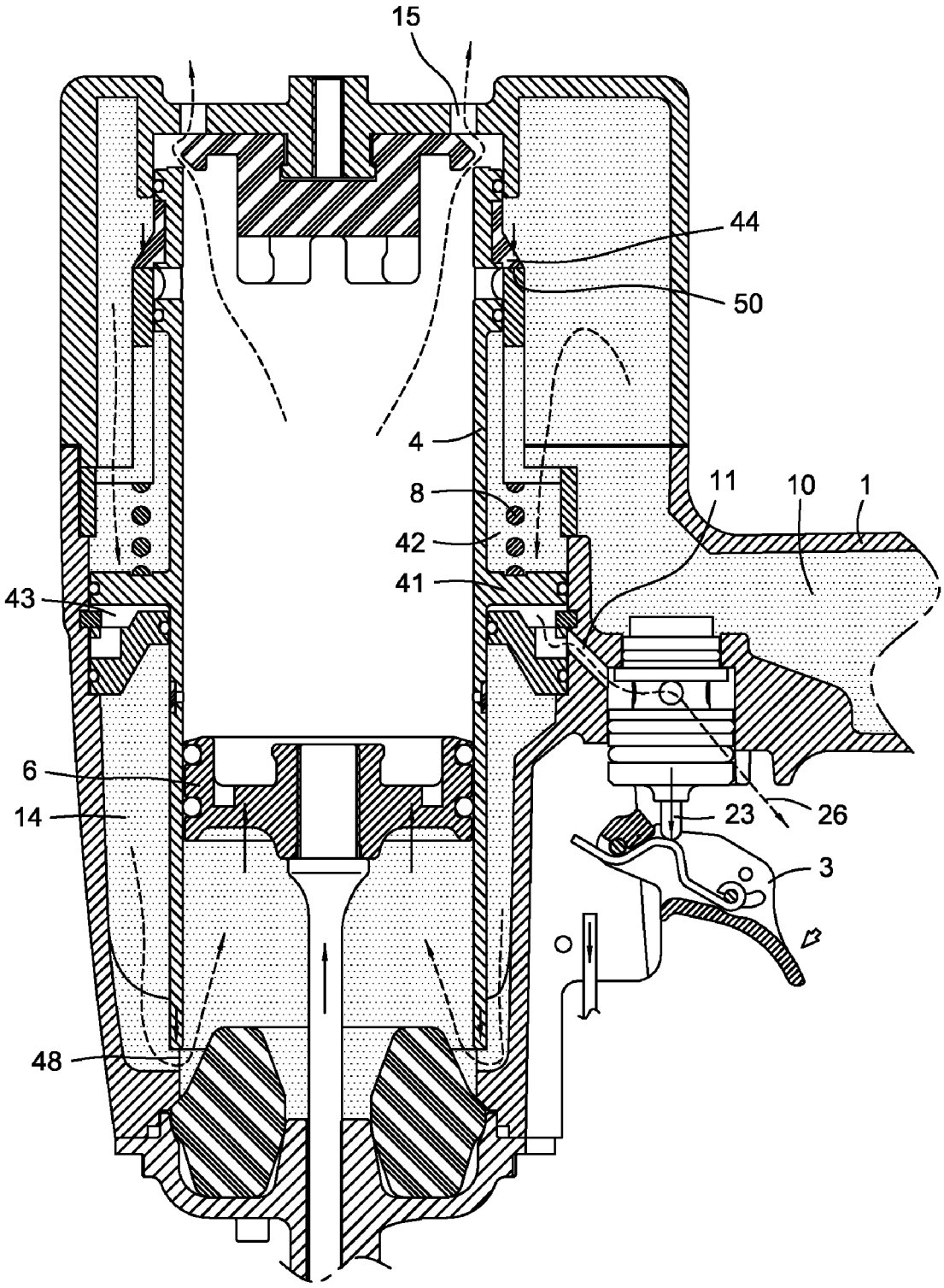
FIG. 6 is a schematic, cross-sectional view of part of the nail gun of FIG. 1, showing a state of releasing the valve bar.

When the valve bar 23 is released (as shown in FIG. 6), the high pressure air in the main chamber 43 is exhausted to external atmosphere via the main passage 11 and the air-out passage 26, to actuate the high pressure in the air tank 42 and the spring 8 to drive the cylinder 4 to move down to reposition. At the same time, the upper air exhausting hole 15 is opened and the main valve 44 closes the main valve port 50, and the high pressure air in the return chamber 14 are guided into the cylinder 4 via the bottom through hole 48, to drive the piston 6 to move up to reposition. After that, the gun body 1 returns to the state of before the valve bar being pressed.

Compared to the related art, this moveable cylinder driving air passage omits the head valve, which simplifies the configurations and assembled process. Moreover, the trigger valve is capable of guiding the high pressure air into the cylinder while valve bar is pressed to drive the trigger valve opened, which improves a rate of guiding the high pressure air into the cylinder and a utilization efficiency of energy of the high pressure air for driving a piston to hit nails.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A moveable cylinder driving air passage of a nail gun with a gun body, the gun body having a moveable cylinder, an air collecting chamber and a main passage, the air passage comprising:

a trigger valve between the air collecting chamber and the main passage;

an air-in passage formed in the trigger valve connecting between the air collecting chamber and the main passage;

an air-out passage formed in the trigger valve connecting between the main passage and external atmosphere;

a valve bar slidably disposed in the trigger valve, the valve bar being capable of closing the air-in passage and opening the air-out passage while being released, and opening the air-in passage and closing the air-out passage while being pressed;

a stopper ring formed at an outside surface of the moveable cylinder and slidably attached in the gun body;

an air tank formed at an upper portion of the stopper ring;

a main chamber formed at a bottom portion of the stopper ring, the main chamber connecting with the air-in passage and the air-out passage; and a cylinder sleeve disposed at the outside surface of the moveable cylinder and at an inner surface of the gun body, wherein the air tank is formed in the cylinder sleeve, and the cylinder sleeve comprises at least one through hole for continuously guiding the high pressure air from the air collecting chamber into the air tank;

wherein the main chamber is capable of collecting the high pressure air via the air-in passage to actuate the moveable cylinder to move up while the valve bar is pressed, and the main chamber is also capable of exhausting the high pressure air via the air-out passage to actuate the moveable cylinder to move down for reposition while the valve bar is released.

2. The moveable cylinder driving air passage as claimed in claim 1, wherein the cylinder sleeve comprises a main valve port formed at an upper portion thereof, adjacent to the air collecting chamber, and the moveable cylinder comprises a main valve formed at an upper portion thereof for opening the main valve port while the moveable cylinder moving up and closing the main valve port while the moveable cylinder moving down for reposition.

3. The moveable cylinder driving air passage as claimed in claim 2, wherein the moveable cylinder comprises a top through hole adjacent to an end of the main valve, the high pressure air is capable of being guided from the air collecting chamber into the moveable cylinder via the top through hole while the main valve port is opened, and the top through hole is blocked while the main valve port is closed.

4. The moveable cylinder driving air passage as claimed in claim 1, further comprising a spring disposed between the cylinder sleeve and the stopper ring for driving the moveable cylinder to move down.

5. The moveable cylinder driving air passage as claimed in claim 1, further comprising a spacing ring formed between the outside surface of the moveable cylinder and the inner surface of the gun body, and the main chamber is formed between an upper portion of the spacing ring and the bottom portion of the stopper ring.

6. The moveable cylinder driving air passage as claimed in claim 1, wherein the main chamber is connected with the air-in passage and the air-out passage via the man passage of the trigger valve.

* * * * *